US008479524B2

(12) United States Patent
Poyyapakkam et al.

(10) Patent No.: US 8,479,524 B2
(45) Date of Patent: Jul. 9, 2013

(54) COMBUSTION CHAMBER ARRANGEMENT FOR OPERATING A GAS TURBINE

(75) Inventors: Madhavan Narasimhan Poyyapakkam, Mellingen (CH); Fulvio Magni, Nussbaumen (CH); Nadir Ince, Rugby (GB)

(73) Assignee: Alstom Technology Ltd., Baden (CH)

( * ) Notice: Subject to any disclaimer, the term of this patent is extended or adjusted under 35 U.S.C. 154(b) by 828 days.

(21) Appl. No.: 12/625,793

(22) Filed: Nov. 25, 2009

(65) Prior Publication Data

US 2010/0126184 A1 May 27, 2010

(30) Foreign Application Priority Data

Nov. 25, 2008 (CH) ..... 1838/08

(51) Int. Cl.
*F02C 7/20* (2006.01)

(52) U.S. Cl.
USPC ..... 60/797; 60/752; 60/755; 60/757; 60/799; 60/800; 277/416; 277/543

(58) Field of Classification Search
USPC ..... 60/752, 754, 755, 756, 757, 796, 60/799, 800, 797, 804; 277/416
See application file for complete search history.

(56) References Cited

U.S. PATENT DOCUMENTS

| | | | | |
|---|---|---|---|---|
| 3,811,276 | A | 5/1974 | Caruel et al. | |
| 3,965,066 | A * | 6/1976 | Sterman et al. | 60/800 |
| 4,380,906 | A | 4/1983 | Dierberger | |
| 5,361,576 | A | 11/1994 | Muller | |
| 5,398,496 | A * | 3/1995 | Taylor et al. | 60/796 |
| 5,983,643 | A | 11/1999 | Kiesow | |
| 6,751,962 | B1 * | 6/2004 | Kuwabara et al. | 60/800 |
| 2002/0174658 | A1 | 11/2002 | Monty et al. | |
| 2008/0179837 | A1 | 7/2008 | Ryan | |

FOREIGN PATENT DOCUMENTS

| | | | |
|---|---|---|---|
| DE | 4223828 | A1 | 12/1993 |
| DE | 19615910 | B4 | 9/2006 |
| EP | 0049190 | A | 4/1982 |
| WO | 2007000409 | A1 | 1/2007 |

* cited by examiner

*Primary Examiner* — Ehud Gartenberg
*Assistant Examiner* — Steven Sutherland
(74) *Attorney, Agent, or Firm* — Volpe and Koenig, P.C.

(57) ABSTRACT

A combustion chamber arrangement is described for operating a gas turbine, with a combustion chamber wall which encloses the combustion chamber space and in the region of the combustion chamber outlet encloses a flow passage for hot gases which develop inside the combustion chamber, has a combustion chamber wall edge which freely terminates in the axial flow direction of the hot gases. The combustion chamber wall edge is formed with a profile which blocks or at least inhibits a diffuser effect when a cooling air flow, which is guided axially through the flow passages into the annular spatial area, flows over the combustion chamber wall edge.

8 Claims, 4 Drawing Sheets

A

COMBUSTION CHAMBER ARRANGEMENT FOR OPERATING A GAS TURBINE

FIELD OF INVENTION

The invention relates to a combustion chamber arrangement for operating a gas turbine, with a combustion chamber wall which encloses the combustion chamber space.

BACKGROUND

In the case of a combustion chamber arrangement of the aforesaid generic type, in which the combustion chamber wall on the outlet side leads in an overlapping manner into a hot gas housing by means of which the hot gases which are formed inside the combustion chamber are fed to a gas turbine stage, mechanical stresses between the combustion chamber wall and the hot gas housing, contingent upon thermally different coefficients of material expansion, are consequently avoided by the combustion chamber wall leading into the hot gas housing with a radial clearance and including with this housing a gap which extends over a specific axial region.

Such combustion chamber arrangements are used for example in conjunction with so-called silo burners, DE 42 23 828 A1 being representatively referred to for a more detailed explanation thereof. Such combustion chamber arrangements are also found in the case of annular combustion chambers which provide a multiplicity of individual combustion chambers which are extended in a star-shaped arrangement around the rotor arrangement of a gas turbine installation and of which each individual combustion chamber is fired by a burner or a burner arrangement. The downstream-side ends of the individual combustion chambers lead in each case into a hot gas housing which feeds the hot gases into a first expansion stage of the gas turbine installation which is provided coaxially along the rotor arrangement. Concerning this, DE 196 15 910 B4 may be representatively referred to.

From the partial longitudinal sectional view which is schematically shown in FIG. 2, the connecting region between combustion chamber wall 1 and hot gas housing 2 is illustrated in more detail. It may be assumed that the combustion chamber wall 1 and also the hot gas housing 2 which adjoins downstream to the combustion chamber wall 1 are formed largely cylindrically and rotationally symmetrically around the axis A. It may additionally be assumed that upstream to the flow direction S which is shown in FIG. 2 a burner arrangement is provided for firing the combustion chamber 3, in which hot gases develop which propagate along the flow direction S and flow over the combustion chamber wall edge 4, which is shown in FIG. 2, into the hot gas housing 2 which directs the hot gases downstream in a gas turbine stage, which is not shown in more detail, for purposeful expansion.

For avoiding stage leakages and thermally induced mechanical stresses between the combustion chamber wall 1 and the hot gas housing 2 which adjoins it downstream, the combustion chamber wall 1 by its freely terminating combustion chamber wall edge 4 leads inside the hot gas housing 2 with an axial overlap 5, wherein the combustion chamber wall 1 has a radial clearance 6 in relation to the hot gas housing 2.

For fastening of the annular seal 9, the hot gas housing 2 makes provision on its upstream end for individual collar-like fasteners 7 which are arranged in a distributed manner in the circumferential direction around the hot gas housing 2 and which on one side are connected in a fixed manner, preferably via a weld joint 8, to the hot gas housing 2. In this case, it is to be noted that the annular seal is largely characterized by a ring which makes a temperature-dependent dilatation or restriction possible. The individual collar-like fasteners 7 engage with this annular seal 9 which fully encompasses the outer side of the combustion chamber wall 1 in the circumferential direction and is joined to this with pressing force applied in such a way that the annular seal 9 experiences an axially tight seating in relation to the combustion chamber wall 1.

In FIG. 3, an axial view of the annular seal 9 which lies around the combustion chamber wall 1 is shown. For its part, this comprises a multiplicity of individual so-called sealing segments 10 which in the circumferential direction, on the end face side, are joined to each other in pairs in each case via connecting structures 11.

The collar-like fasteners 7, as can be seen schematically in FIGS. 2 and 5, radially and axially span the individual sealing segments 10 and ensure that the individual sealing segments 10 of the annular seal 9 have a degree of freedom, which is established in the various planes, in relation to burner wall 1 and hot gas housing 2.

All the sealing segments 10 inside the annular seal 9 do not terminate flush with the outer side of the combustion chamber wall 1, but on their surface which faces the combustion chamber wall have rib-like elevations which extend parallel to each other and with the combustion chamber wall 1 therefore enclose a multiplicity of flow passages 12 through which cooling air K is directed. With reference to FIG. 2, it is apparent that the cooling air K which is directed through the individual flow passages 12 reaches the annular spatial area 13 which is radially delimited by means of the axially mutually overlapping combustion chamber wall 1 and the hot gas housing 2. As a result of the inflow of cooling air K close to the wall along the inner wall of the hot gas housing 2, film cooling develops on this, by means of which the hot gas housing can be effectively cooled in comparison to the high temperature level of the hot gases.

For reasons of a simplified installation, it is advisable not to fasten the fasteners 7, which are formed like a collar, directly on the hot gas housing 2 which in most cases is formed in one piece, but on a flange wall 15 which, via a weld joint 14, is connected flush to the hot gas housing 2 in an axial direction and, however, is furthermore considered as part of said hot gas housing 2.

The operation of such a burner arrangement, however, reveals distinctive features in need of improvement which are associated with the occurrence of local overheating phenomena at the location of the hot gas housing 2 in the region downstream of the combustion chamber wall edge 4. Such overheating phenomena occur in the form of overheated, streak-like wall regions which extend locally in the flow direction and create periodically recurring local overheating spots in the circumferential direction along the inner wall of the hot gas housing 2.

More detailed investigations have shown that the local overheated inner wall regions of the hot gas housing 2 are created as a result of, or at least in association with, hot gas circulations which occur in the region of the combustion chamber wall edge 4, as a result of which portions of the hot gas reach the annular spatial area 13 via the combustion chamber wall edge 4 and are able to locally disturb the previously described film cooling along the inner wall of the hot gas housing 2. The wall overheating which develops repeatedly in the manner of streaks downstream along the inner wall of the hot gas housing 2 can lead to irreversible wall damage, the weld joint 14, along which the flange wall 15 is connected to the rest of the hot gas housing 2, particularly suffering significant damage.

SUMMARY

The present disclosure is directed to a combustion chamber arrangement for operating a gas turbine. The chamber includes a combustion chamber wall which encloses the combustion chamber space and in a region of the combustion chamber outlet encloses a flow passage for hot gases which develop inside the combustion chamber. The combustion chamber wall has a combustion chamber wall edge which freely terminates in an axial flow direction of the hot gases. With an axial overlapping and also with a radial clearance, leads downstream into a hot gas housing which radially encompasses the combustion chamber wall. Indirectly or directly upon the hot gas housing are attached individual collar-like fasteners which project upstream over the hot gas housing. The fasteners are arranged in a distributed manner in the circumferential direction of the hot gas housing, and are attached on an outer side on the combustion chamber wall upstream to the combustion chamber wall edge for axial fixing of an annular seal. The combustion chamber wall is completely encompassed in the circumferential direction by the annular seal which comprises a multiplicity of individual sealing segments which on an end face side are joined to each other in each case via connecting structures. The connecting structures on one side axially indirectly or directly adjoin the hot gas housing and with the outer-side combustion chamber wall are delimited by axially oriented flow passages which on one side lead into an annular spatial area which is radially delimited by the axially mutually overlapping combustion chamber wall and hot gas housing. The combustion chamber wall edge is formed with a profile which blocks or at least inhibits a diffuser effect when a cooling air flow, which is guided axially through the flow passages into the annular spatial area, flows over the combustion chamber wall edge.

BRIEF DESCRIPTION OF THE DRAWINGS

The invention is subsequently exemplarily described without limitation of the general inventive idea based on exemplary embodiments with reference to the drawing. All elements which are not necessary for the direct understanding of the invention have been omitted. Like elements are provided with the same designations in the various figures. The flow direction of the media is indicated with arrows. In the drawing.

DETAILED DESCRIPTION OF THE PREFERRED EMBODIMENTS

Introduction to the Embodiments

Figure 1:
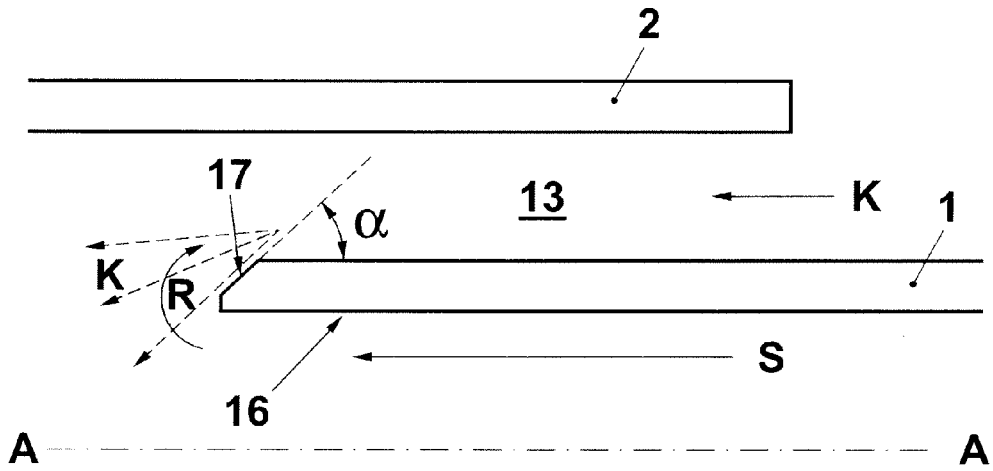
FIG. 1 shows a schematized detailed view of a profiled combustion chamber wall edge.

The disclosure is based on the object of developing a combustion chamber arrangement of the aforesaid generic type in such a way that measures are found, by means of which the thermally induced damage on the inner wall of the hot gas housing is to be avoided. In particular, it is necessary to search for measures with which the periodically recurring local overheating spots can be effectively prevented. It is of particular interest to realize the modifications which are required for this largely without losses which reduce the combustion process and also the overall efficiency of the gas turbine installation.

The achieving of the object upon which the disclosure is based is disclosed in claim 1. Features which advantageously develop the inventive idea are the subject of the dependent claims and are also to be gathered from the further description with reference to the exemplary embodiments.

According to the solution, it could be shown that a combustion chamber arrangement according to the disclosure should be constructed for the purpose of effective elimination of the overheating on the inner wall of the hot gas housing 2 related to the periodically recurring local overheating spots. The development according to an embodiment is that the combustion chamber wall edge is formed in a profiled manner in such a way that when cooling air flow, which is directed axially through the flow passages into the annular space area, flows axially over the combustion chamber wall edge, the same cooling air flow experiences a purposeful, position-relevant inflow as a result of the planned profiling.

Because the flow which is initiated as a result of the profiling of the combustion chamber wall edge leads to a sustainable disturbance of a developing diffuser action with regard to the cooling air flow which leads through the flow passages of the annular seal 9 in an axial direction into the annular spatial area and downstream ensures film cooling of the inner wall of the hot gas housing 2, the tendency of the hitherto developing recirculation of hot gas portions around the combustion chamber wall edge in the direction of the annular spatial area is effectively prevented, as a result of which the local overheating problems can be effectively counteracted within the limits of the overheating spots which repeatedly develop there.

Thus, within the scope of a multiplicity of tests carried out both numerically and experimentally it was demonstrated that a diffuser action in particular is effectively established if a bevel of the combustion chamber wall edge is present. For blocking or at least repressiving the diffuser action, no beveling of the combustion chamber wall in relation to the facing wall of the hot gas housing ideally would have to be provided, but which would then inevitably lead to installation problems without beveling. Therefore, with regard to this bevel angle it is intended to keep this as small as possible on the one hand in order to decisively block the diffuser action, but on the other hand to operate with a bevel angle which enables a good joining together of combustion chamber wall and hot gas housing.

Furthermore, within the scope of numerous tests it was possible to establish that leakage flows can occur which additionally lead to local overheating spots.

Such leakage flows originate from cooling air portions which are in the position to pass through the annular seal 9 through cracks or gaps in the region of the respective connecting structures, that is to say those regions in which two adjacent sealing segments are interconnected in the circumferential direction towards the outer side of the combustion chamber wall. In order to avoid these leakage flow portions as much as possible, or to at least reduce them to an insignificant level, it is necessary to accurately match the joining contours in the region of the connecting structure to each other and to form them in such a way that the gap dimensions which exist in the region of the connecting structures are reduced to a minimum. On the one hand, this affects all the axially extending surface areas along which two adjacent sealing segments 10 come into contact with each other on the end face side in each case via their connecting structure, but, on the other hand, especially affects the radially extending joint regions, as is further explained in more detail based on a concrete exemplary embodiment.

The creation of a multiplicity of radially oriented through-passages through the hot gas housing in the region of the previously described flange wall 15 or at the upstream-side end of the hot gas housing, which are arranged in an uniformly distributed manner in the circumferential direction around the hot gas housing, provides a further possibility for reducing the hot gas portions which penetrate into the annular spatial area on account of recirculation flows. Through each of the individual through-passages, cooling air, which flows radially or virtually radially from the outside inwards, is fed into the annular spatial area between the hot gas housing and the combustion chamber wall. Such a cooling air feed, however, also has influence upon the forming film cooling along the inner wall of the hot gas housing so that a finely metered adjustment of the cooling air flow, which is directed through the individual through-passages radially into the inner spatial region, is undertaken in order to avoid on the one hand the disturbing recirculation flow, and on the other hand to leave the forming film air cooling as unaffected as possible.

For the description of further constructional measures for effective countering of the developing garland effect during operation of a combustion chamber in question, the subsequent exemplary embodiments may be referred to with reference to the figures.

DETAILED DESCRIPTION

Figure 2:
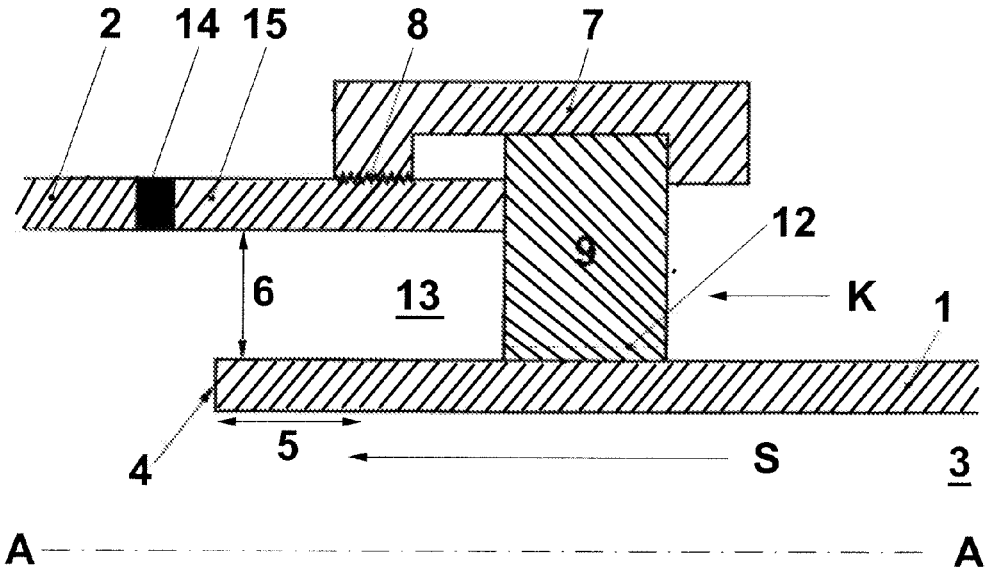
FIG. 2 shows a schematized partial longitudinal section through a combustion chamber arrangement as known per se.
Figure 3:
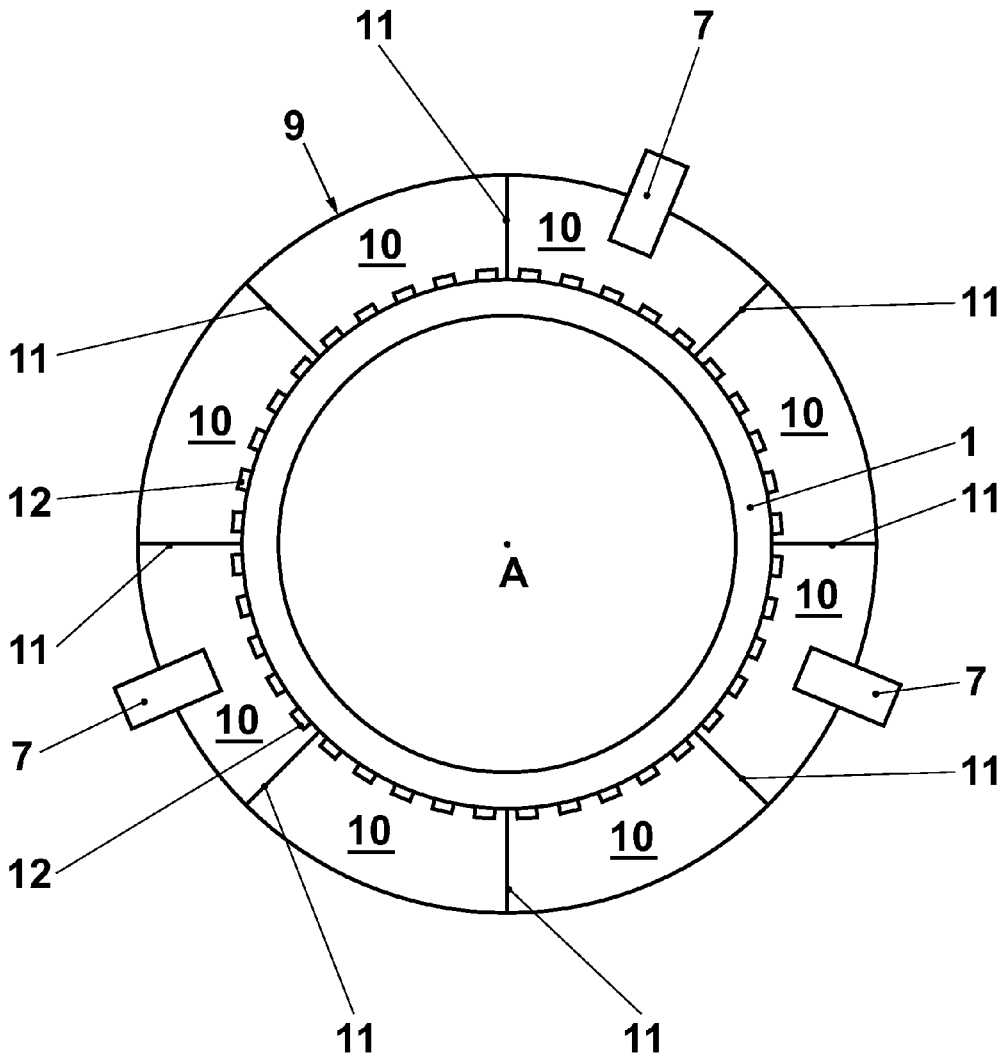
FIG. 3 shows a schematized axial view of a sealing segments as known per se with inner lying combustion chamber wall.

The designations which are introduced and explained with reference to the exemplary embodiment which is previously described for the prior art and shown in FIGS. 2 and 3, are also further used for like or similar components.

In FIG. 1, the downstream end of the combustion chamber wall 1 with the end-side combustion chamber wall edge 4 is shown. It may be assumed that the inner wall 16 of the combustion chamber wall 1 faces the hot gas flow S. In order to avoid the recirculations R, symbolized by a curved arrow, which develop in the case of conventional combustion chamber arrangements of the aforesaid generic type in the region of the combustion chamber wall edge 4, through which the hot gas portions reach the annular spatial area 13 which is delimited between the hot gas housing 2 and the combustion chamber wall 1 in each case, the combustion chamber wall edge 4 has a bevel with a bevel surface 17 which faces the inner wall of the hot gas housing 2 and which with the rest of the combustion chamber wall 1 includes an acute angle $\alpha$ which is preferably to be selected as large as possible, wherein the angle $\alpha$ of this bevel surface 17 is related to the outer surface of the combustion chamber wall 1. Naturally, variations of the angle $\alpha$ are also possible, this basically being able to be varied in a range between 20 and <90°, but the best results for avoiding damaging hot gas recirculations were established with an angle of 40°.

According to the present understanding, the bevel in the region of the end-face termination of the combustion chamber wall 1 basically promotes a diffuser action with regard to the cooling air flow K which axially penetrates the annular spatial area 13 because this effectively promotes a backflow of hot gases S into the spatial region 13. As a result of this, overheating phenomena along the inner wall of the hot gas housing 2 ensue.

Figure 4:
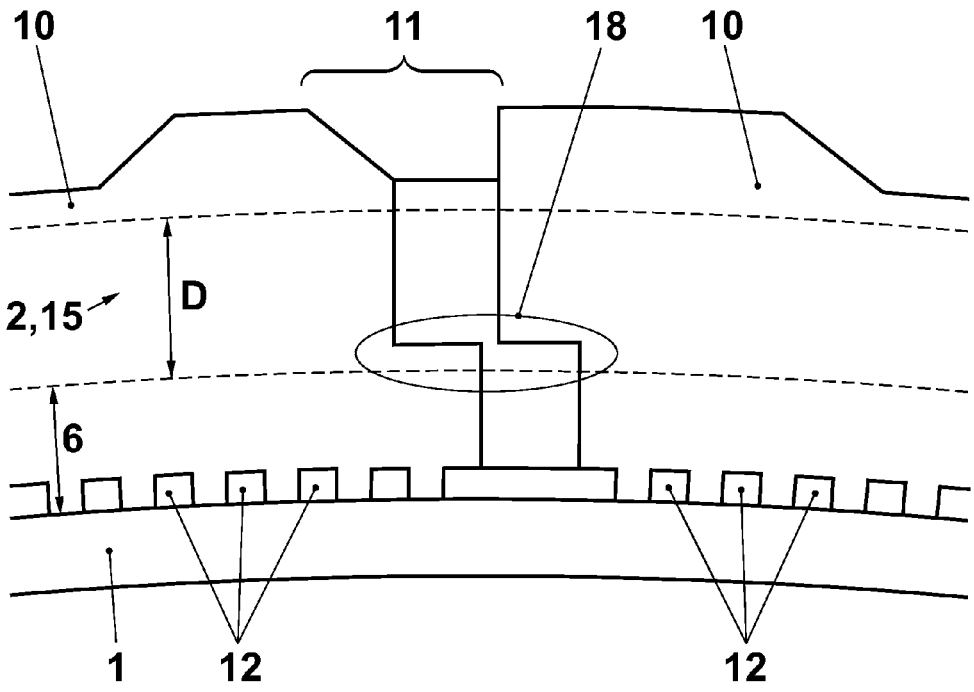
FIG. 4 shows a schematized axial view of two sealing segments which are to be connected on the outer side of the combustion chamber wall.

A further measure in order to create a remedy in relation to the wall overheating of the hot gas housing 2 is shown in FIG. 4, in which in the axial direction of view two adjoining sealing segments 10 are shown which can be brought into engagement with each other via a connecting structure 11. The sealing segments 10 have a surface of rib-like design which faces the outer side of the combustion chamber wall 1 and which with the combustion chamber wall 1 encloses axially oriented cooling passages 12 through which cooling air can be directed in a purposeful manner into the downstream-side annular spatial area 5 (see FIG. 2). Of particular interest is the avoidance of cooling air leakage flows, especially through gaps and cracks in the region of the connecting structure 11, which are especially able to impair the further developing film air cooling. For avoiding such leakage flows, the individual sealing segments 10 on their end sides have surface sections which are mutually characterized by overlapping and contacting and which after joining together create a type of labyrinth seal. The labyrinth seal which exists between the two sealing segments 10 has a step contour 18, as is apparent from FIG. 4, with a step section which is oriented in the circumferential direction. The step section of the step contour 18 has a radial ledge which in axial projection is overlapped by the wall thickness D of the hot gas housing 2, which adjoins the sealing segment 9 downstream, in conjunction with the flange wall 15. As a result of the previously described overlapping of the step contour 18 by the wall thickness D of the hot gas housing 2, the effect of flow portions of cooling air being able to get through the labyrinth seal into the downstream-side spatial region 5 can be excluded at least to a large extent. In FIG. 4, the radial extent 6 of the annular spatial area 13 which is enclosed by hot gas housing 2 and combustion chamber wall 1 is also apparent.

Figure 5:
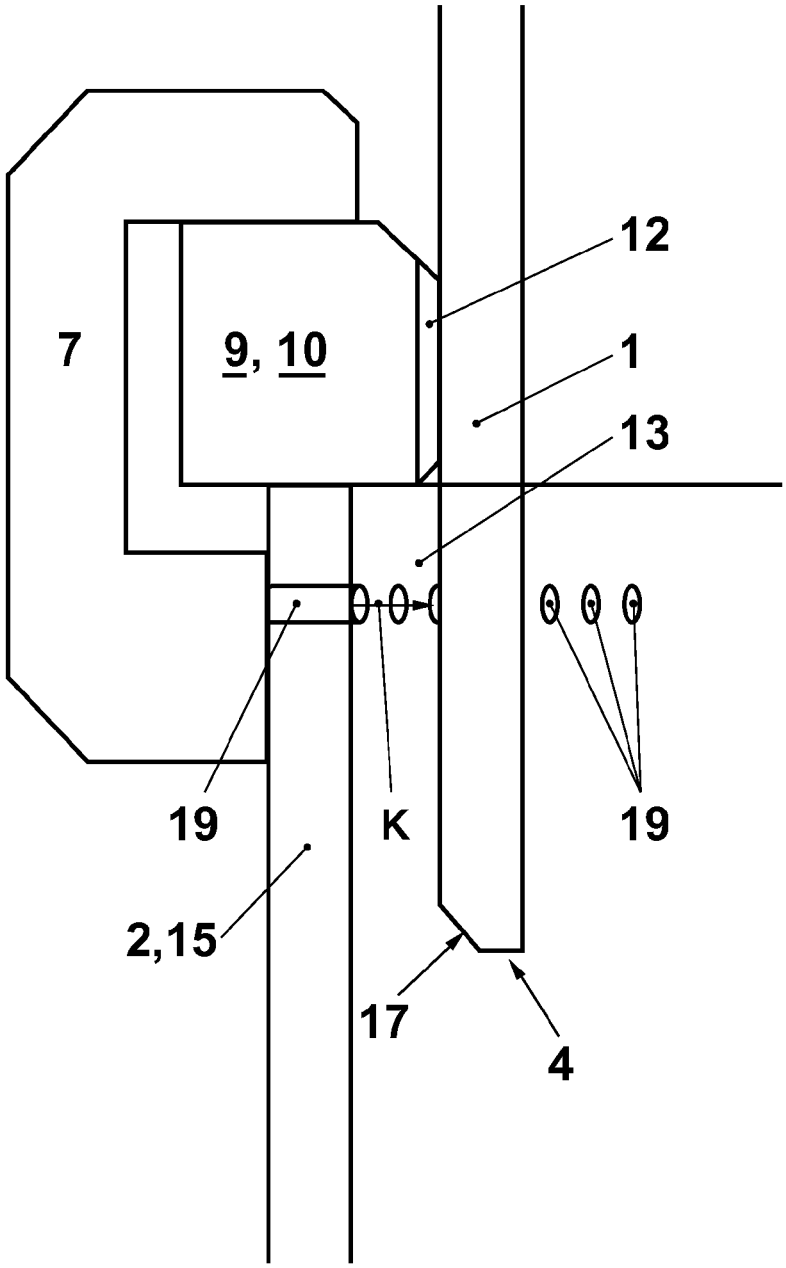
FIG. 5 shows a schematized view of the joint region between combustion chamber wall and hot gas housing with radially oriented through-passages.

In FIG. 5, a further measure for countering possible recirculation flows into the annular spatial area 13 is indicated. FIG. 5 shows a partially perspective view of the connecting region between the hot gas housing 2 and the combustion chamber wall 1, on the combustion chamber wall edge 4 of which the bevel 17 according to the solution is applied. With reference to the radial overlapping of the step contour 18 by the wall thickness D (see FIG. 4) of the hot gas housing 2 which is described in FIG. 4, according to FIG. 5 this advantageously has a wall thickness increase which is formed at the upstream end of the hot gas housing 2.

In addition, the hot gas housing 2, inside the indicated region, has a multiplicity of radially oriented through-passages 19 which are uniformly arranged along the entire circumference of the hot gas housing 2. By these radially oriented through-passages 19 additional cooling air K reaches the region of the annular spatial area 13 for further countering of developing recirculation flows which can lead to local overheating spots.

LIST OF DESIGNATIONS

1 Combustion chamber wall
2 Hot gas housing
3 Combustion chamber
4 Front combustion chamber wall edge
5 Overlapping
6 Radial gap width
7 Collar-like fastener
8 Weld joint
9 Annular seal
10 Sealing segment
11 Connecting structure
12 Flow passage
13 Annular spatial area
14 Weld seam
15 Flange wall
16 Inner side of the combustion chamber wall

17 Bevel surface
18 Step contour
19 Radial through-passages
S Hot gas flow
K Cooling passages, cooling air
R Recirculation flow
D Wall thickness

What is claimed is:

1. A combustion chamber arrangement for a gas turbine comprising:

a combustion chamber wall, which encloses a combustion chamber space for hot gases which develop inside the combustion chamber; the combustion chamber wall having an aft combustion chamber which freely terminates in an axial flow direction of the hot gases, the combustion chamber wall axially overlapping and radially spaced within a hot gas housing with a radial clearance between the combustion chamber wall and the hot gas housing;

an annular seal, wherein the combustion chamber wall is completely encompassed in the circumferential direction by the annular seal which comprises a plurality of individual sealing segments which on an end face side are joined to each other in each case via connecting structures, on one side axially indirectly or directly adjoining the hot gas housing and with the outer-side combustion chamber wall delimited by axially oriented flow passages which on one side lead into an annular spatial area radially delimited by the axially mutually overlapping combustion chamber wall and hot gas housing;

a plurality of collar-like fasteners indirectly or directly attached to the hot gas housing, the collar-like fasteners projecting upstream over the hot gas housing, arranged in a distributed manner in the circumferential direction of the hot gas housing, and attached to the annular seal on an outer side on the combustion chamber wall upstream to the aft combustion chamber wall edge; and the aft combustion chamber wall edge formed with a profile which blocks or at least inhibits the hot gases in the combustion chamber space from flowing radially outward into the annular spatial area, the profiling of the combustion chamber wall edge is a bevel with a bevel surface which faces the hot gas housing, the bevel angled at an angle $\alpha$, where $\alpha=40°\pm10°$.

2. The combustion chamber arrangement as claimed in claim 1, wherein the collar-like fasteners are incorporated in the circumferential direction on the outer side around a flange wall which is connected to the hot gas housing upstream.

3. The combustion chamber arrangement as claimed in claim 2, wherein the flange wall is connected to the hot gas housing via a releasable or non-releasable connection which extends in the circumferential direction of the hot gas housing.

4. The combustion chamber arrangement as claimed in claim 2, wherein the individual sealing segments have a longitudinal extent which is oriented in the circumferential direction of the combustion chamber wall and a curvature adapted to the combustion chamber wall, the connecting structures of each individual sealing segment, which are provided in each case on the end face in the longitudinal extent, are formed in such a way that the connecting structures of two interconnected sealing segments in each case provide mutually overlapping and contacting surface sections in the form of a labyrinth seal at least in the circumferential direction.

5. The combustion chamber arrangement as claimed in claim 4, wherein the labyrinth seal which exists between two sealing segments has a step contour with a step section which is oriented in the circumferential direction, and the step section which is oriented in the circumferential direction, between all the sealing segments which are attached around the combustion chamber wall and interconnected in pairs in each case, is overlapped in axial projection by the wall thickness of the hot gas housing.

6. The combustion chamber arrangement as claimed in claim 4, wherein the labyrinth seal which is provided between two sealing segments has a step contour with a step section which is oriented in the circumferential direction, and the step section which is oriented in the circumferential direction, between all the sealing segments which are attached around the combustion chamber wall and interconnected in pairs in each case, is overlapped in axial projection by the wall thickness of the flange wall.

7. The combustion chamber arrangement as claimed in claim 2, wherein in the region of the flange wall a multiplicity of radially oriented through-passages are formed and arranged in a distributed manner in the circumferential direction around the flange wall in such a way that a cooling air flow which is directed through the through-passages penetrates into the annular spatial area between the flange wall and the combustion chamber wall.

8. The combustion chamber arrangement as claimed in claim 1, wherein the sealing segments are joined to each other in pairs in each case via the connecting structures.

* * * * *